United States Patent [19]

Woolslayer et al.

[11] Patent Number: 4,587,778

[45] Date of Patent: May 13, 1986

[54] METHOD AND APPARATUS FOR ERECTING A DRILLING RIG MAST

[75] Inventors: Homer J. Woolslayer; Cecil Jenkins, both of Tulsa, Okla.

[73] Assignee: Lee C. Moore Corporation, Tulsa, Okla.

[21] Appl. No.: 658,352

[22] Filed: Oct. 5, 1984

[51] Int. Cl.[4] ..... E04H 12/34

[52] U.S. Cl. ..... 52/116; 52/741

[58] Field of Search ..... 52/116, 117, 120, 119, 52/118, 741, 745; 212/182, 188, 183; 173/151

[56] References Cited

U.S. PATENT DOCUMENTS

| | | |
|---|---|---|
| 2,695,081 | 11/1954 | Woolslayer et al. . |
| 2,701,039 | 2/1955 | Woolslayer et al. . |
| 2,711,804 | 6/1955 | Woolslayer et al. . |
| 2,822,895 | 7/1961 | Poetker . |
| 3,016,992 | 1/1962 | Wilson . |
| 3,194,411 | 7/1965 | Durand . |
| 3,228,151 | 1/1966 | Woolslayer et al. . |
| 3,271,915 | 9/1966 | Woolslayer et al. . |
| 3,333,377 | 8/1967 | Woolslayer . |
| 3,416,267 | 12/1968 | Maniu . |
| 3,747,695 | 7/1973 | Branham . |
| 3,807,109 | 4/1974 | Jenkins et al. . |
| 3,922,825 | 12/1975 | Eddy et al. . |
| 3,942,593 | 3/1976 | Reeve, Jr. et al. . |
| 4,138,805 | 2/1979 | Patterson . |
| 4,221,088 | 9/1980 | Patterson . |
| 4,375,241 | 3/1983 | Gallon . |

*Primary Examiner*—John E. Murtagh

*Attorney, Agent, or Firm*—Laney, Dougherty, Hessin, Claro & Beavers

[57] ABSTRACT

A method and apparatus for erecting a drilling rig mast. The foot of a drilling rig mast is pinned to the base of a substructure. A traveling block is strung with a crown block at the top of the mast and the traveling block is secured to the substructure. A drawworks mounted on the substructure reels in traveling block line thus pivoting the end of the mast upwardly. The foot of the mast is unpinned and raised to the top of the substructure where it is pinned in a shoe. The drawworks reels in additional cable thus pivoting the mast into an upright position at which point it is secured for drilling or other operations.

21 Claims, 6 Drawing Figures

METHOD AND APPARATUS FOR ERECTING A DRILLING RIG MAST

BACKGROUND AND SUMMARY OF THE INVENTION

The instant invention relates to methods and apparatus for erecting a drilling rig mast and more particularly to such methods and apparatus wherein the foot of the mast is pinned to a substructure to permit pivoting of the mast into position for drilling or other operations.

The typical drilling rig, in assembled condition, includes a substructure having a substantially vertical mast mounted on the top thereof. The mast includes at its top a crown block from which a traveling block is suspended via a wire line. A drawworks is mounted on the top of the substructure and is used to reel line in and out thereby raising and lowering the traveling block. In accordance with past methods and apparatus for assembling such a drilling rig, the substructure is erected on a base which rests on the ground with the drawworks being mounted on the top of the substructure. The lower end or foot of the mast is then pinned to a pair of shoes on the top of the substructure. Thereafter, wire from the drawworks is strung between the crown block and traveling block. A cable is attached to the traveling block and is looped over a pulley which is supported by a gin pole at the top of the substructure. The other end of the cable is secured to the mast adjacent the foot thereof. When line is reeled in by the drawworks, the mast pivots upwardly about the shoes until it is in a vertical position at which point it is secured to the top of the substructure for drilling or other operations.

The foregoing-described operation for erecting a drilling rig mast works satisfactorily for substructures having a reasonably low height. As the search for oil and gas has led to the drilling of deeper and deeper wells, the height of substructures has increased in order to accomodate the large pressure-controlled equipment which must be secured to the well head beneath the substructure. Generally speaking, the deeper the well, the taller the substructure will be. Substructures can be as tall as thirty-seven feet and above.

If the foot of a mast is pinned to the top of a tall substructure, the top of the mast angles downwardly toward the ground and, when considering the weight of the mast, presents a load which cannot be pivoted into an upright position by the drawworks. The end of the mast can of course be elevated to the same height as the substructure by placing it on a support so that the mast will be substantially parallel to the ground; however, providing a support sufficiently sturdy to support the end of the mast at the height of the substructure and placing the mast on the top thereof creates an involved and expensive additional step in the erection of the mast.

The instant invention provides an advantage over the above-described prior art technique in that a drawworks may be used to mount a mast on a relatively tall substructure without the disadvantages attendant in the above-described prior art technique.

The instant invention includes means for pivotally attaching the foot of the mast to the base of a substructure. The end of the mast is then pivoted upwardly and the foot of the mast is detached from the substructure. The foot of the mast is then raised upwardly until it is at the point on the substructure at which it is to be secured for drilling or other operations. The foot of the mast is then pivotally attached to the substructure at that point and the end of the substructure is pivoted upwardly until the mast is in the position in which it is to be used for drilling or other operations.

These and other advantages of the instant invention will become apparent when the following detailed description is read in view of the accompanying drawings wherein.

DETAILED DESCRIPTION OF THE PREFERRED EMBODIMENT OF THE INVENTION

Figure 1:
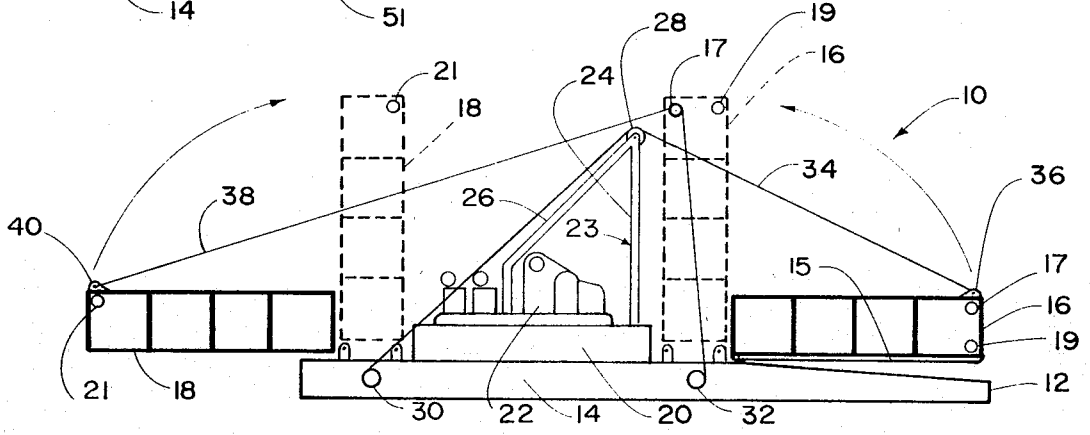
FIG. 1 is a side view of a portion of the apparatus of the instant invention in somewhat schematic form.

Indicated generally at 10 is a portion of the apparatus of the instant embodiment of the invention. Included therein is a substructure base 12 which includes a pair of elongate main frames constructed of steel elements, one of which is frame 14. The substructure base includes another elongate main frame (not visible), like frame 14 which is behind and spaced in parallel relation away from frame 14 as seen in FIGS. 1–4. A pair of front end frames, one of which is end frame 16 are pivotally attached to their associated main frames, like end frame 16 is attached to main frame 14. The other front end frame is to the rear of end frame 16, spaced apart therefrom and hingingly connected to the main frame behind main frame 14. An upright track 15, is mounted on the front of frame 16. A similar track (not visible) is mounted on the front of the other front end frame. A pair of pulleys 17, 19 are mounted for rotation at the top of end frame 16. The track structure and that of pulleys 17, 19 will be further described hereinafter. A rear end frame 18 is pivotally attached to main frame 14 opposite end frame 16. A pulley 21 is mounted for rotation at the top of end frame 18. Another rear end frame, not visible, is pivotally attached behind main frame 18, viewed in FIGS. 1–4, to the main frame behind main frame 14. In FIG. 1, end frames 16, 18 are shown in dashed lines in their upright configurations. U.S. Pat. No. 3,333,377 to Woolslayer for Assembly of Substructure-Constructing Components and Method of Constructing Tall Substructures discloses a similar substructure base with end frames which pivot into position.

In FIG. 1, a drawworks supporting unit 20 rests on top of the substructure base and supports thereon a drawworks 22. Substructure base 12, the front and rear end frames and unit 20 are herein referred to collectively as a substructure. Also mounted on unit 20 is a conventional gin pole 23 having front legs, one of which is leg 24, the other front leg being obscured behind leg 24. A pair of rear legs, one of which is leg 26, the other rear leg being obscured therebehind, extend downwardly and to the rear from the top of legs 24. Pulleys, one of which is pulley 28 are journaled for rotation between legs 24, 26 and the other legs.

Four winches, two of which are winches 30, 32 are mounted on substructure base 12, with each winch being mounted beneath one of the four end frames, like winch 32 is mounted beneath end-frame 16 and like winch 30 is mounted beneath end-frame 18. The other two winches (not visible) are mounted on the substructure base beneath the other two end frames (also not visible).

Winch 30 includes a line 34 which, in the configuration shown in FIG. 1, is strung over one of the pulleys on gin pole 23 and is attached to a shoe 36 adjacent the top of end frame 16. A line 38 from winch 32 is wound over pulley 17 (when the end frame is in its upright position) and is attached to a shoe 40 adjacent the top of end frame 18.

Figure 2:
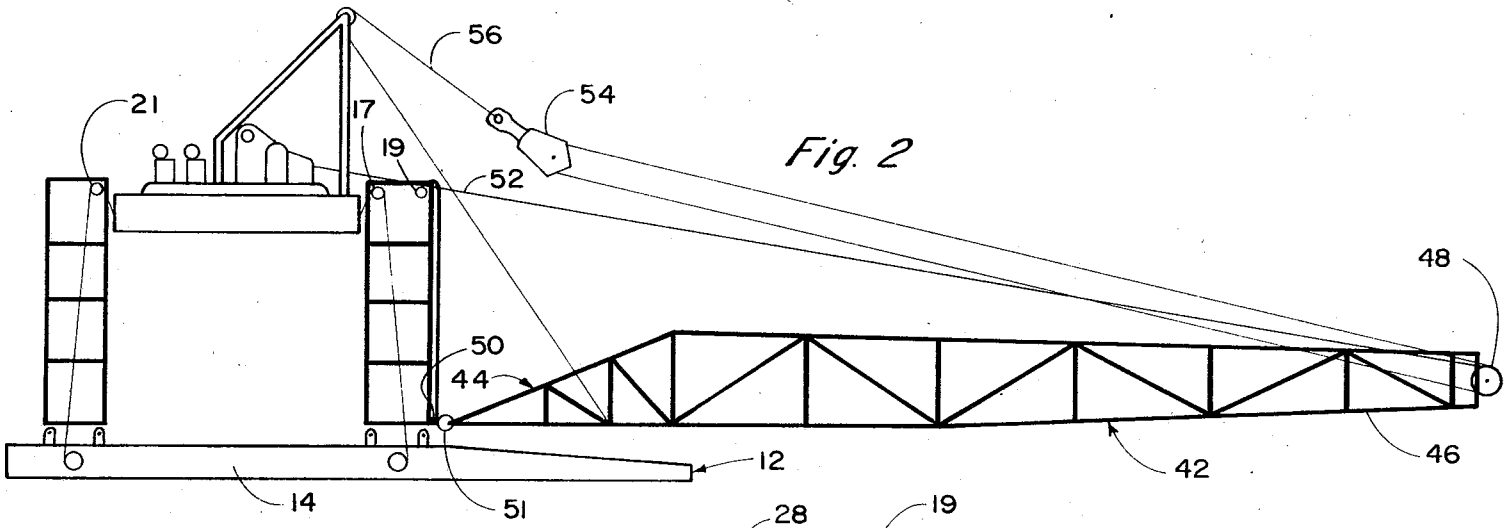
FIG. 2 is a side view similar to FIG. 1 and including a mast.
Figure 3:
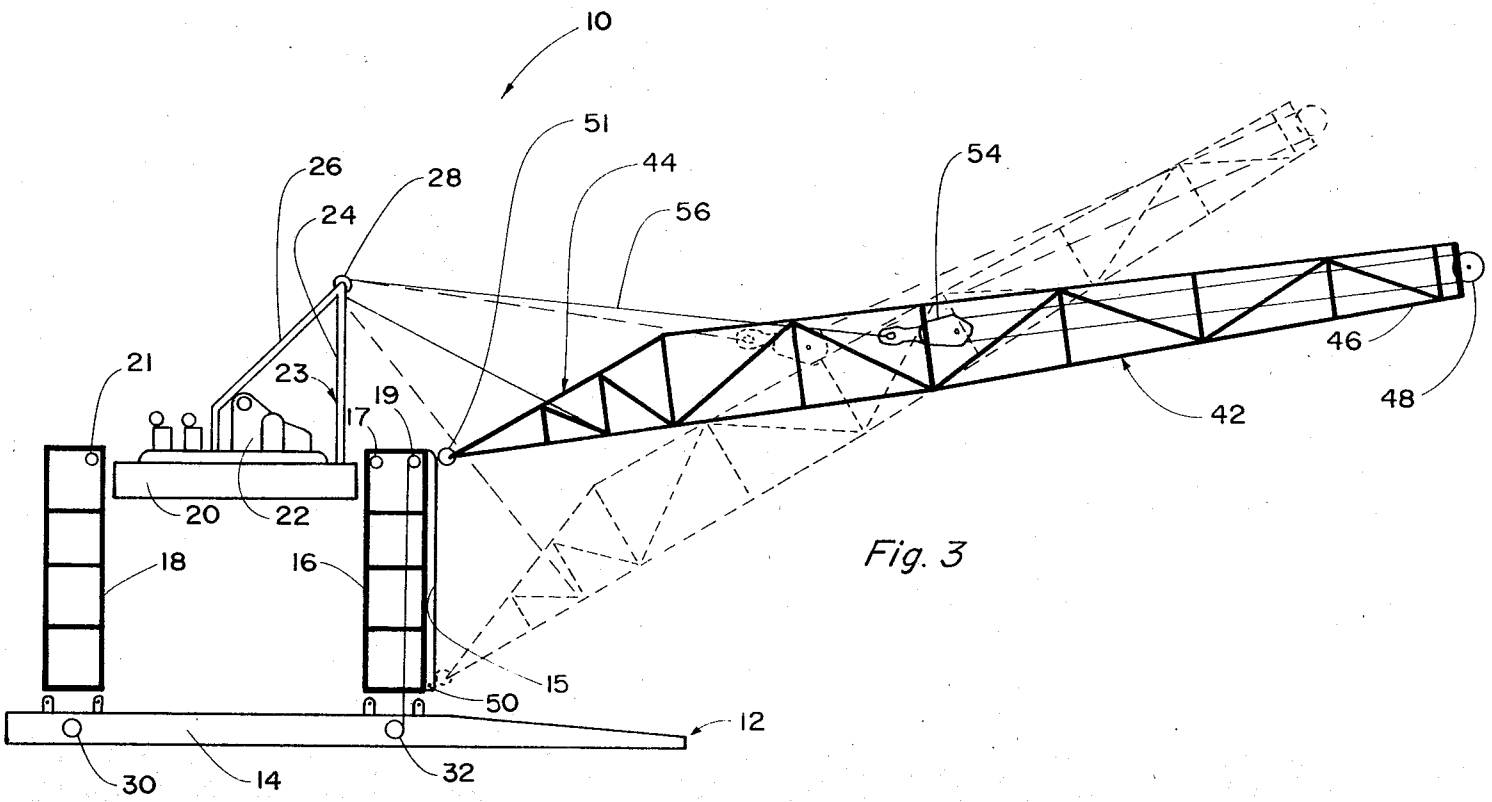
FIG. 3 is a side view similar to FIG. 2 showing the mast in two different positions during the process of erecting the mast.
Figure 4:
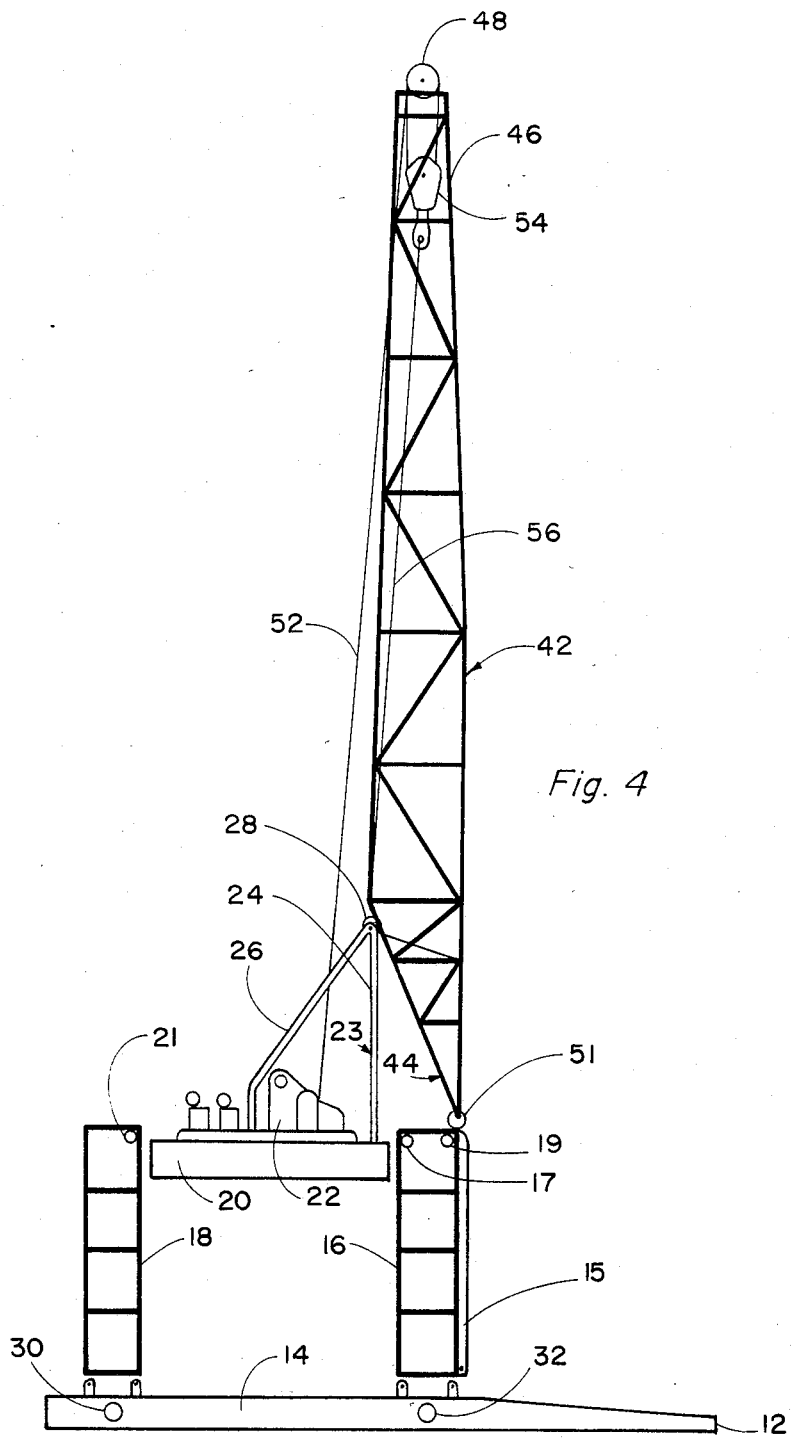
FIG. 4 is a side view similar to FIG. 3 showing the mast in an upright position.

A mast 42, in FIGS. 2–4 has a foot 44 and an end 46 with a conventional crown block 48 mounted on the end of the mast. The foot of the mast is pinned to the substructure adjacent the base thereof via a pin-and-shoe connection 50. A roller 51 is mounted for rotation at the foot of the mast. The structure of connection 50 and roller 51 will be described in greater detail hereinafter.

A line 52 is wound on drawworks 22 in the usual fashion. In FIGS. 2–4, line 52 is shown strung over crown block 48 and through pulleys (not visible) on a traveling block 54 in a conventional manner. The end of line 52 (not shown) is secured to the substructure so that when drawworks 22 reels in line 52, traveling block 54 moves toward crown block 48. A cable 56 is attached at one end to the traveling block and is looped over a pulley on gin pole 23 as shown in FIGS. 2–4 with the other end of cable 56 being attached to the mast as shown.

Figure 5:
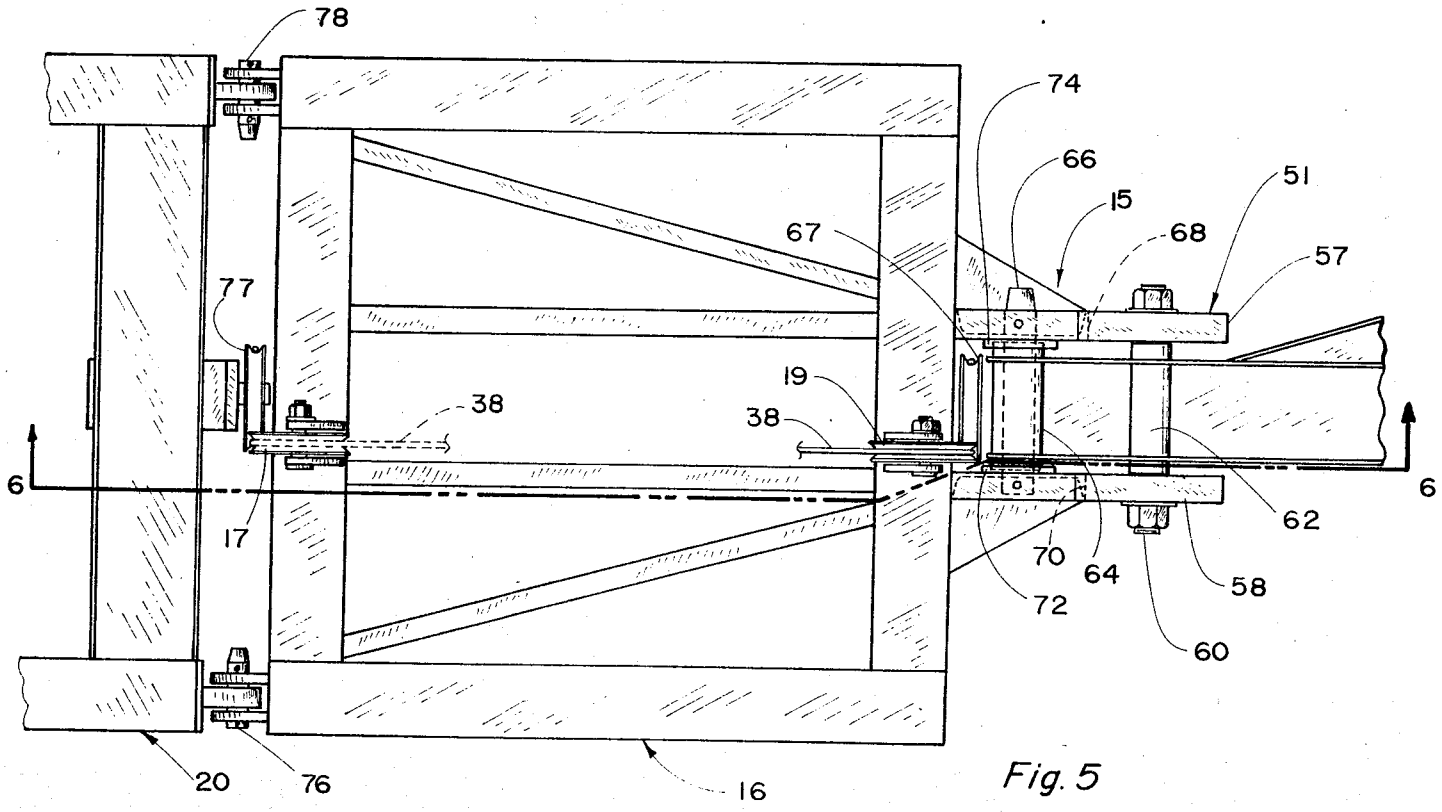
FIG. 5 shows a top view of a portion of the preferred embodiment of the invention with the foot of the mast at the top of the substructure.
Figure 6:
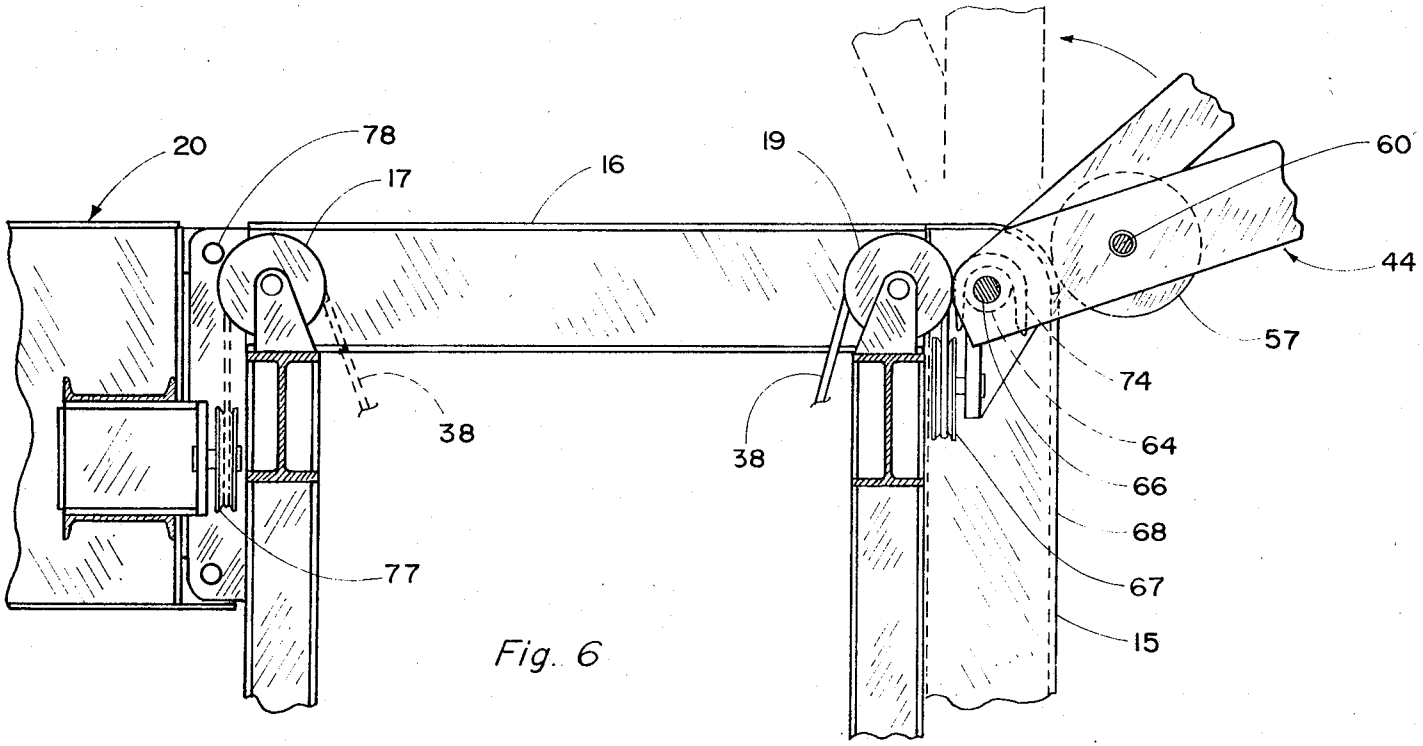
FIG. 6 is a view taken along line 6—6 in FIG. 5.

Finishing now the description of the apparatus of the invention, in FIGS. 5 and 6, structure which has been previously identified in FIGS. 1–4 is identified in FIGS. 5 and 6 with the same number. Roller 51 includes a pair of wheels 57, 58 mounted on an axle 60. Axle 60 is received within a cylinder 62 which is fixedly secured to mast foot 44. A second cylinder 64 is secured to the mast as shown and receives therethrough a pin 66. Mounted on the lowermost end of mast foot 44 is a pulley 67. A pin, similar to pin 66 may be received through holes in track 15 like pin 66 in FIG. 5, to form connection 50, shown in FIG. 2, at the lower end of the track.

Track 15 includes a pair of edges 68, 70 against which wheels 57, 58, respectively, are rollingly engaged. As can be seen in FIGS. 1–4, track 15 extends from the top of the substructure to the bottom. A pair of u-shaped stops, also referred to therein as stop means, 72, 74 are mounted on track 15 just above the holes through which pin 66 is received. It is to be appreciated that foot 44 of the mast includes another lower portion identical to that shown in FIGS. 5 and 6 and which is received within a track, like track 15, which is mounted on the front end frame behind end frame 16 as viewed in FIGS. 1–4. Likewise, the other end frame includes pulleys similar to pulleys 17, 19 in end-frame 16. A pulley 77 is mounted on drawworks-supporting unit 20 as shown in FIGS. 5 and 6. In the view of FIGS. 5 and 6, unit 20 is pinned via pin-and-slot connections 76, 78 to end-frame 16. In a similar fashion, unit 20 is pinned to each of the other end frames and includes additional pulleys, like pulley 77, associated with its other pin-and-slot connections.

In operation, when it is desired to erect a drilling rig mast in accordance with the apparatus and method of the instant invention, the apparatus is first situated as shown in FIG. 1. That is, the end frames are pivotally secured to substructure base 12 as shown and line 34 from winch 30 is connected to shoe 36 over a pulley on gin pole 23. The line from the winch beneath the other rear end frame is connected to the shoe on its opposed front end frame (not visible) in a similar fashion. Once the lines are so connected, the winches are activated to reel in line thus pivoting each of the front end frames to an upright position as shown in dashed lines in FIG. 1 and in solid lines in FIGS. 2–4. Once so positioned the front end frames are secured to substructure base 12 via pins in a conventional fashion. Thereafter, line from the winches beneath the front end frames, like line 38, is reeved over a pulley in its associated end frame, like pulley 17, and is connected to shoes, like shoe 40, at the top of the rear end frames. Reeling in line on the winches raises the rear end frames to their upright position at which point they are pinned to base 12.

Next, mast 42 is positioned as shown in FIG. 2 and is pivotally secured to the base of the substructure via pin-and-shoe connection 50. Once the mast is so secured, line from the drawworks is run between crown block 48 and traveling block 54 with the end of the line being secured to substructure base 12 in a conventional fashion. Thereafter, cable 56 is connected to traveling block 54 and is placed over a pulley on gin pole 23, as shown in FIG. 2, with the other end of the cable being secured to the mast as shown. When line 52 and cable 56 are arranged as shown in FIG. 2, the lines from winches 30, 32 are reeved over pulleys 21, 17, respectively, as shown in FIG. 2. Line 38 from winch 32 is thereafter reeved beneath pulley 77, in FIGS. 5 and 6, and the end of line 38 is secured to the top of end frame 16. Each of the other four winches is reeved in a similar fashion with its associated pulley, like pulley 17, on the end frame beneath which the winch is mounted and on its associated pulley, like pulley 77, on unit 20. The reeving for line 38 on pulleys 17, 77 is shown in dashed lines in FIGS. 5 and 6. Thereafter, all of the winches are simultaneously activated to reel in line thereby raising unit 20 to the position shown in FIG. 2. Pin-and-slot connections like connections 76, 78, are then used to pin unit 20 to the top of each of the end frames. As unit 20 is raised, traveling block 54 raises upwardly to the position shown in FIG. 2.

Once unit 20 has been pinned to the end frame, each of the winches, like winch 32, associated with the front end frames is reeved over the pulleys, like pulley 19, adjacent the top of the track, like track 15, which is mounted on the end frame. The reeving for line 38 is shown in solid lines in FIGS. 5 and 6. Line 38 is reeved over pulley 19, under pulley 67 and the end thereof is fixedly secured to the top of end frame 16. It is to be appreciated that at this stage of the assembly operation, the foot of the mast is at the base of the substructure and that therefore pulleys 19, 67 are separated by a distance equal to approximately the height of the substructure.

With the structure assembled as described above, the drawworks is activated to begin reeling in line. When such occurs, traveling block 54 is drawn toward the crown block and the end of the mast begins pivoting upwardly, shown in dashed lines in FIG. 3. Thereafter, the pins which pivotally secure the foot of the mast to the base of the substructure via pin-and-shoe connections, like connection 50, are removed. The winches, like winch 32, beneath the front end frames are activated to reel in line thus pulling the foot of the mast upwardly along track 15. As can be seen in FIGS. 5 and 6, wheels 57, 58 roll upwardly along track edges 68, 70, respectively. When the foot of the mast reaches the top of track 15, cylinder 64 abuts stops 72, 74 thus preventing further upward movement. Similar stop action occurs on the other track. When such occurs, pin 66 is slipped into cylinder 74 via holes in track 15 thus pivotally securing the foot of the mast to the top of the substructure. At this stage of the operation, the mast is positioned as shown in solid lines in FIG. 3.

Thereafter, drawworks line is again reeled in thus further pivoting the end of the mast toward the drawworks until the mast is in a substantially upright position as shown in FIG. 4 at which point it abuts gin pole 23 thus preventing further pivotal movement. As can be seen in FIG. 6, the top of track 15 is rounded thus enabling roller 51 to continuing rolling on track 15 until the mast assumes an upright position. A portion of mast foot 44 is shown in dashed lines in FIG. 6 illustrating the position of the mast in the upright position as shown in FIG. 4. When the mast is positioned as shown in FIG. 4, further reeling of line on the drawworks is stopped, cable 56 is removed, and the mast is pinned to the gin pole in a conventional fashion thus securing it for drilling or other operations. When it becomes desirable or necessary to disassemble the drilling rig, the above-described steps are repeated in substantially reverse order in order to disassemble the drilling rig.

It is to be appreciated that modifications and additions can be made to the foregoing described apparatus and method without departing from the spirit of the invention which is defined in the claims as follows:

We claim:

1. A method for mounting a mast on a substructure having a drawworks mounted thereon comprising the steps of:

placing the mast in a horizontal position with the foot of the mast being adjacent the lower portion of the substructure;

pivotally attaching the foot of the mast to the lower portion of the substructure;

connecting the drawworks cable to the mast;

pivoting the end of the mast upwardly about the foot of the mast by reeling in drawworks cable;

detaching the foot of the mast from the lower portion of the substructure;

raising the foot of the mast to a point on the substructure at which it is to be secured for drilling or other operations while maintaining the end of the mast in its raised condition with the drawworks cable;

pivotally attaching the foot of the mast to said point; and further pivoting the end of the mast upwardly about the foot of the mast to the position in which it is to be used for drilling or other operations.

2. The method of claim 1 wherein when the mast is placed adjacent the substructure, the foot of the mast is adjacent the base of the substructure.

3. The method of claim 1 wherein when the mast is first raised, it is raised until the end of the mast is just above the top of the substructure.

4. The method of claim 1 wherein when the foot of the mast is raised, it is raised vertically.

5. The method of claim 1 wherein the foot of the mast is raised to the top of the substructures.

6. A method for mounting a mast having a traveling block strung on a substructure having a drawworks, which includes the line on which the traveling block is strung, and a gin pole mounted therein, said method comprising the steps of:

placing the mast in a horizontal position with the foot of the mast being adjacent the base of the substructure;

pivotally attaching the foot of the mast to the base of the substructure;

connecting one end of a cable to the traveling block;

running the cable over the grin pole and connecting the other end to the mast;

activating the drawworks to reel in line to pivot the end of the mast upwardly about the foot of the mast;

detaching the foot of the mast from the base of the substructure;

raising the foot of the mast to the point on the substructure at which it is to be secured for drilling or other operations while maintaining the end of the mast in its raised condition with the drawworks cable;

pivotally attaching the foot of the mast to said point; and activating the drawworks to further reel in line until the mast is in an upright position.

7. The method of claim 6 wherein when the drawworks is first activated, line is reeled in until the end of the mast is just above the top of the substructure.

8. The method of claim 6 wherein when the foot of the mast is raised, it is raised vertically.

9. The method of claim 6 wherein the foot of the mast is raised to the top of the substructure.

10. Apparatus for mounting a mast on a substructure comprising:

first means for pivotally attaching the foot of the mast to the substructure adjacent its base;

second means for pivotally attaching the foot of the mast to the substructure at the top thereof;

a vertical track extending between said first and second means; and roller means mounted on the foot of said base for rollingly engaging said track, said mast foot being engageable with said pivotally attaching means when said roller means is so engaged.

11. The apparatus of claim 10 wherein said apparatus further includes stop means adjacent the upper portion of said track, said stop means preventing further upward movement of said mast foot along said track.

12. The apparatus of claim 10 wherein said raising means further includes a winch mounted on said substructure.

13. The apparatus of claim 10 wherein said pivoting means includes a drawworks mounted on said substructure.

14. An assembly for drilling a well comprising:

a substructure base;

a drawworks-supporting unit above the central portion of said base;

an upright substructure end frame at each end of said unit resting on said base;

means hinging the bottoms of the end frame to the base so that said frames can be swung from an upright position to a reclining position extending away from each other;

a winch mounted on said base substantially beneath each end frame;

a track mounted on the outward-facing side of one of said end frames; and a mast having a foot which is engageable with said track for sliding movement therealong.

15. The apparatus of claim 14 wherein said apparatus further includes means for pivotally attaching said mast foot end to the lower end of said track.

16. The apparatus of claim 14 wherein said apparatus further includes means for pivotally attaching said mast foot end to the upper end of said track.

17. The apparatus of claim 14 wherein said apparatus further includes stop means for preventing sliding movement of said mast foot end above said pivotally attaching means.

18. The apparatus of claim 14 wherein said track is substantially vertical.

19. The apparatus of claim 14 wherein said mast has a roller mounted on the foot end thereof for rolling on said track.

20. The apparatus of claim 11 which each of said pivotally attaching means comprises:

a bore through the foot of said mast;

a bore through said substructure; and a pin receivable through said bores when said bores are coaxially aligned.

21. The apparatus of claim 20 wherein said second pivotally attaching means bores are substantially coaxially aligned when further upward movement of said mast foot along said track is prevented by said stop means.

* * * * *

UNITED STATES PATENT AND TRADEMARK OFFICE

CERTIFICATE OF CORRECTION

PATENT NO. : 4,587,778

DATED : May 13, 1986

INVENTOR(S) : Woolslayer et al.

It is certified that error appears in the above-identified patent and that said Letters Patent is hereby corrected as shown below:

In the claims: Column 6, line 12 -- grin pole -- should read "gin pole"

Signed and Sealed this

*Twenty-sixth* Day of *August 1986*

[SEAL]

*Attest:*

DONALD J. QUIGG

*Attesting Officer*

*Commissioner of Patents and Trademarks*